US008864942B2

(12) United States Patent
Tomoda et al.

(10) Patent No.: US 8,864,942 B2
(45) Date of Patent: Oct. 21, 2014

(54) PROCESS FOR PRODUCING BLEACHED PULP

(75) Inventors: Iori Tomoda, Kanagawa (JP); Yosuke Uchida, Chiba (JP); Hiroyuki Nagatani, Tokyo (JP); Ayano Kawae, Tokyo (JP); Takahiro Cho, Saitama (JP); Wakana Uesugi, Tokyo (JP); Tetsuo Koshitsuka, Saitama (JP)

(73) Assignee: Mitsubishi Gas Chemical Company, Inc., Tokyo (JP)

( * ) Notice: Subject to any disclaimer, the term of this patent is extended or adjusted under 35 U.S.C. 154(b) by 0 days.

(21) Appl. No.: 13/571,233

(22) Filed: Aug. 9, 2012

(65) Prior Publication Data

US 2013/0062026 A1 Mar. 14, 2013

Related U.S. Application Data

(62) Division of application No. 12/301,130, filed as application No. PCT/JP2007/059930 on May 15, 2007, now Pat. No. 8,268,123.

(30) Foreign Application Priority Data

May 17, 2006 (JP) ..... 2006-137850

(51) Int. Cl.
*D21C 9/14* (2006.01)
*D21C 9/16* (2006.01)
*D21C 9/10* (2006.01)

(52) U.S. Cl.
CPC ..... *D21C 9/144* (2013.01); *D21C 9/1036* (2013.01); *D21C 9/163* (2013.01); *D21C 9/1084* (2013.01); *D21C 9/1042* (2013.01)
USPC ..... 162/78; 162/88

(58) Field of Classification Search
CPC ..... D21C 9/166; D21C 9/14; D21C 9/142; D21C 9/144; D21C 9/1057
USPC ..... 162/78, 88
See application file for complete search history.

(56) References Cited

U.S. PATENT DOCUMENTS

| | | | | |
|---|---|---|---|---|
| 4,404,061 | A | 9/1983 | Cael | |
| 5,091,054 | A * | 2/1992 | Meier et al. | 162/65 |
| 5,246,543 | A | 9/1993 | Meier et al. | |
| 5,266,158 | A | 11/1993 | Hill et al. | |
| 5,411,635 | A | 5/1995 | Francis et al. | |
| 5,439,663 | A * | 8/1995 | Manganaro et al. | 423/521 |
| 5,587,049 | A | 12/1996 | Marzolini et al. | |
| 5,589,032 | A * | 12/1996 | Chang et al. | 162/76 |
| 5,645,686 | A | 7/1997 | Troughton et al. | |
| 5,698,075 | A | 12/1997 | Troughton et al. | |
| 6,511,578 | B2 | 1/2003 | Dorn et al. | |
| 2002/0117276 | A1 | 8/2002 | Dorn et al. | |
| 2003/0178164 | A1 * | 9/2003 | Ragnar | 162/49 |
| 2004/0112555 | A1 | 6/2004 | Tolan et al. | |
| 2005/0031530 | A1 | 2/2005 | Martin | |

FOREIGN PATENT DOCUMENTS

| | | |
|---|---|---|
| DE | 44 22 307 | 12/1995 |
| EP | 0 622 491 | 11/1994 |
| EP | 0 553 649 | 9/1996 |
| EP | 0 560 421 | 7/1997 |
| EP | 0 968 328 | 12/2004 |
| EP | 1 040 222 | 2/2008 |
| JP | 05-247866 | 9/1993 |
| JP | 06-041889 | 2/1994 |
| JP | 07-150493 | 6/1995 |
| JP | 09-0878985 | 3/1997 |
| JP | 10-500178 | 1/1998 |
| JP | 2004-169194 | 6/2004 |
| RU | 2173741 | 9/2001 |
| WO | WO 92/15752 | 9/1992 |
| WO | WO 94/18386 | 8/1994 |
| WO | WO 94/20674 | 9/1994 |
| WO | WO 94/21856 | 9/1994 |
| WO | WO 95/35405 | 12/1995 |
| WO | WO 97/19222 | 5/1997 |
| WO | WO 98/42911 | 10/1998 |
| WO | WO 99/32710 | 7/1999 |
| WO | WO 03/083208 | 10/2003 |
| ZA | 9401468 | 11/1994 |

OTHER PUBLICATIONS

Gullichsen editor, Chemical Pulping 6A, 1999, Fapet Oy,p. A635-A665.*

Yoshida et al., Test Methods of ISO Brightness and Color, 2002, Japan Tappi Journal, vol. 56, abstract only.*

Bradley, Kappa/K calculator, downloaded online Mar. 7, 2013, downloaded from www.temap.com/misc/kappa.html.*

Ragauskas, Hexenuronic Contents of SW Kraft Pulps under various ECF and TCF bleaching sequence, downloaded online Mar. 7, 2013, IPST @ Georgia Tech.*

Jiang et al., Hexenuronic acid groups in pulping and bleaching chemistry,2000,Tappi Journal, vol. 83 No. 1, p. 167-175.*

Bradley, Kappa/K calculator, Nov. 2005, downloaded online Jun. 27, 2013, downloaded from www.temap.com/misc/kappa.html.*

(Continued)

*Primary Examiner* — Anthony Calandra
(74) *Attorney, Agent, or Firm* — Antonelli, Terry, Stout & Kraus, LLP.

(57) ABSTRACT

A method for producing bleached pulp, including processing unbleached pulp obtained by cooking a lignocellulose substance, followed by treatment with peroxomonosulfuric acid and thereafter by multistage chlorine-free bleaching treatment starting from chlorine dioxide treatment; a method for producing bleached pulp, including processing unbleached pulp for alkali-oxygen bleaching followed by chlorine-free bleaching treatment or totally chlorine-free bleaching treatment to bleach it to a degree of brightness of from 70 to 89%, and further followed by treatment with peroxomonosulfuric acid; and paper produced by the use of the bleached pulp produced according to these production methods, at a papermaking pH of at most 6.

13 Claims, No Drawings

(56) References Cited

OTHER PUBLICATIONS

Kawamura et al., Relationship Between Cookin/Bleaching Conditions and Hexenuronic Acid Content in Kraft Pulp, 2003, TAPPI 2003 Fall Technical Conference.*

Sobotka, Werner, The Value of Different Standards and Measurment Systems to Determine the Optical Properties of Paper and for Standardized Color Reproduction, 1989, SPIE vol. 1184, p. 158-167.*

Lapierre, The Limits of Metal Removal From Kraft Pulp by Acid Treatment, 1996, International Pulp Bleaching Conference, p. 515-517.*

Kronis et al., Caro's Acid—An Improvement over Hydrogen Peroxide for Brightening Pulp, 1998, TAPPI Pulping Conference Proceedings.*

Chinese Official Action dated Nov. 30, 2011, for CN Application No. 200780017527.3.

R. W. Allison, et al., "Improved oxygen delignification with interstage peroxymonodulfuric acid treatment", *Tappi Journal* vol. 78, No. 10, Oct. 1995, pp. 134-142.

J. Gullichsen, et al., Paper Making Science and Technology, Book 6A, Chemical Pulping, Chapter 9, Bleaching applications, 1999, pp. A616-A-665.

Chinese Official Action dated Aug. 23, 2010, for Application No. 200780017527.3.

Extended European Search Report, including Supplementary European Search Report and European Search Opinion, dated Aug. 18, 2010, for EP Application No. 07743365.4.-2124/2022887 (PCT/JP2007/059930).

Canadian Official Action dated Jan. 7, 2014, for CA Application No. 2,652,325.

* cited by examiner

PROCESS FOR PRODUCING BLEACHED PULP

This application is a Divisional application of prior application Ser. No. 12/301,130, filed Nov. 17, 2008, now U.S. Pat. No. 8,268,123, the contents of which are incorporated herein by reference in their entirety. Ser. No. 12/301,130 is a National Stage Application filed under 35 USC 371, of International (PCT) Application No. PCT/JP2007/059930, filed May 15, 2007.

TECHNICAL FIELD

The present invention relates to a method for producing bleached pulp from a lignocellulose material. More precisely, it relates to a method for producing bleached pulp through elementary chlorine-free bleaching or totally chlorine-free bleaching, in which the colour reversion resistance of the bleached pulp is good and the bleaching cost can be reduced.

BACKGROUND ART

Bleaching of pulp for papermaking is attained in multistage bleaching treatment. Heretofore, in the multistage bleaching, a chlorine-base bleaching chemical is used as the bleaching agent. Concretely, by a combination of chlorine (C), hypochlorite (H) and chlorine dioxide (D), bleaching is attained in a sequence of, for example, C-E-H-D or C/D-E-H-E-D (C/D means a chlorine/chlorine dioxide combined bleaching stage; and E means an alkali extraction stage).

However, in bleaching with them, these chlorine-base bleaching chemicals release, as side products, organic chlorine compounds that are harmful to the environment, and the environmental pollution with the bleaching waste that contain those organic chlorine compounds is considered problematic. Organic chlorine compounds are analyzed and assessed generally by an AOX method, for example, by the U.S. Environment Agency (EPA: METHOD-9020).

For reducing and preventing release of organic chlorine compounds as side products, it is most effective to reduce the amount to be used of chlorine-base chemicals or not to use them; and in particular, it is a most effective method not to use elementary chloride in the initial stage. Pulp produced according to a method of not using elementary chlorine but using chlorine dioxide is referred to as ECF (elementary chlorine-free) pulp; and pulp produced according to a method of using no chlorine-base chemical at all is referred to as TCF (totally chlorine-free) pulp.

As a method of bleaching cooked/oxygen-delignated pulp with chlorine dioxide, not using elementary chlorine in the initial stage, generally known is a sequence of D-Eo-D, D-Eop-D, D-Eo-D-D, D-Eop-D-D, or a sequence of D-Eo-P-D or D-Eop-P-D (p or P means hydrogen peroxide, Eo means an oxygen alkali extraction stage, Eop means an oxygen/hydrogen peroxide alkali extraction stage); and as a bleaching method of using ozone (Z) in the initial stage, generally known is a sequence of Z-Eop-D, Z-Eo-P-D or Z/D-Eop-D ("/" between Z and D means continuous treatment with no washing therebetween).

However, chlorine dioxide and ozone are inferior to chlorine conventionally used in point of the ability to remove hexeneuronic acid (hereinafter abbreviated as "HexA"), and therefore a large amount of HexA remains in the bleached pulp. The remaining HexA is a cause of the deterioration of the colour reversion resistance of ECF or TCF-bleached pulp.

HexA is a substance resulting from demethanolation in a cooking step of glucuronic acid bonding to xylan, a hemicellulose existing in pulp. Though having a small influence on the brightness of pulp, this reacts with potassium permanganate, as having a double bond in the molecule, and is counted as a potassium permanganate (K) value or a κ (kappa) value.

As a papermaking method, there are known an acid papermaking method of using aluminium sulfate, and a neutral papermaking method of using calcium carbonate. Neutral paper worsens in point of the colour reversion resistance with the increase in the HexA content thereof, but the degree of worsening is low; and the colour reversion resistance of acid paper made by the use of aluminium sulfate particularly worsens. The reason why the colour reversion resistance of paper made according to an acid papermaking method is unknown at present, but the existence of HexA and the use of aluminium sulfate may be the reason for it.

In a paper mill, in general, neutral paper and acid paper are made separately from chlorine-free bleached pulp forwarded from a series of bleaching equipment, by the use of a large number of papermaking machines. Accordingly, using the same chlorine-free bleached pulp forwarded from the same bleaching step, acid paper is made in one line and neutral paper is made in the other line. In this case, though the paper made in the neutral papermaking line has no problem, the paper made in the acid papermaking line may have a problem of the colour reversion.

For preventing the colour reversion resistance deterioration, it is necessary to increase the amount to be used of chlorine dioxide or ozone having the ability to remove HexA, thereby removing HexA. In this case, however, the pulp for neutral paper not requiring measures against the colour reversion must also be bleached, therefore increasing too much the brightness of the pulp and causing a problem of great increase in the cost for bleaching.

In place of delignination of unbleached pulp by chlorine bleaching or by a combination of chlorine and chlorine dioxide, known is a method of applying a peracid such as peroxomonosulfuric acid to bleaching (for example, see Patent References 1 to 7). Patent Reference 1 proposes a TCF bleaching method comprising treatment with peroxomonosulfuric acid and then with alkaline hydrogen peroxide.

Patent Reference 2 proposes a bleaching method by a combination of enzyme and peroxomonosulfuric acid.

Patent Reference 3 proposes a bleaching method by chelating agent treatment, alkaline hydrogen peroxide treatment and peroxomonosulfuric acid treatment after oxygen bleaching.

Patent Reference 4 proposes a bleaching method by a combination of peroxomonosulfuric acid and ozone.

Patent Reference 5 proposes a method comprising peroxomonosulfuric acid treatment after chelating agent treatment, and then alkaline hydrogen peroxide treatment in that order.

The methods disclosed by the above-mentioned Patent References 1 to 5 are methods relating to initial-stage delignination treatment in a bleaching step, but the references have no description relating to HexA removal and the colour reversion resistance enhancement.

Patent Reference 6 proposes treatment with a peracid and an alkaline earth metal in the final stage of bleaching. As the peracid, used is peracetic acid; but the main object of this method is for brightness improvement; and the reference has no description relating to HexA removal and the colour reversion resistance enhancement.

Patent Reference 7 proposes a method of adding a bleaching agent between bleaching treatment and a preparation step, as a post-treatment method after bleaching. As a bleaching agent, shown are ozone, hydrogen peroxide, peracetic acid, percarbonic acid, perboric acid and thiourea dioxide; but the main object of this method is for brightness improvement, and the reference has no description relating to HexA removal and the colour reversion resistance enhancement.

[Patent Reference 1] JP-T 6-505063
[Patent Reference 2] JP-A 7-150493
[Patent Reference 3] JP-T 8-507332
[Patent Reference 4] JP-T 8-511308
[Patent Reference 5] JP-T 10-500178
[Patent Reference 6] JP-T 2001-527168
[Patent Reference 7] JP-A 2004-169194

DISCLOSURE OF THE INVENTION

An object of the present invention is to provide a method for producing bleached pulp through chlorine-free bleaching or totally chlorine-free bleaching, in which the colour reversion resistance of the bleached pulp for acid paper can be improved and the bleaching cost can be reduced, and to provide paper made from the bleached pulp through acid papermaking.

The present inventions have made assiduous studies of cooked and alkali-oxygen bleached pulp and, as a result, have found that, in multistage chlorine-free bleaching of alkali-oxygen bleached pulp that starts from treatment with chlorine dioxide after peroxomonosulfuric acid treatment, the amount of chlorine dioxide to be used immediately after the treatment and/or in the latter stage can be reduced, and that the colour reversion resistance of the bleached pulp for acid paper can be enhanced by reducing the amount of HexA in the bleached pulp, and have completed a first embodiment of the present invention.

Further, the present inventors have assiduously studied pulp that has been processed for chlorine-free bleaching or totally chlorine-free bleaching after cooking and alkali-oxygen bleaching and, as a result, have found that, when the pulp that has been processed for chlorine-free bleaching or totally chlorine-free bleaching to a predetermined brightness is further treated with peroxomonosulfuric acid, then the colour reversion resistance of the bleached pulp for acid paper can be enhanced, and have completed a second embodiment of the present invention.

Specifically, the present application includes the following inventions:

(1) A method for producing bleached pulp, comprising processing unbleached pulp obtained by cooking a lignocellulose substance, for alkali-oxygen bleaching followed by treatment with peroxomonosulfuric acid and thereafter by multistage chlorine-free bleaching treatment starting from chlorine dioxide treatment.

(2) The method for producing bleached pulp of above (1), wherein the treatment with peroxomonosulfuric acid is followed by washing.

(3) The method for producing bleached pulp of above (1) or (2), wherein the peroxomonosulfuric acid treatment is attained according to a combination a treating pH of from 2 to 5, a treating temperature of from 40 to 70° C., and a treating time of from 10 to 200 minutes.

(4) A method for producing bleached pulp, comprising processing unbleached pulp obtained by cooking a lignocellulose substance, for alkali-oxygen bleaching followed by chlorine-free bleaching treatment or totally chlorine-free bleaching treatment to bleach it to a degree of brightness of from 70 to 89% (as measured under JIS P 8148 (2001)), and further followed by treatment with peroxomonosulfuric acid.

(5) The method for producing bleached pulp of above (4), wherein the K value of the pulp after the chlorine-free bleaching treatment or the totally chlorine-free bleaching treatment is at least 1.5.

(6) The method for producing bleached pulp of above (4), wherein the amount of hexeneuronic acid in the pulp after the chlorine-free bleaching treatment or the totally chlorine-free bleaching treatment is at least 10 μmol/pulp(g).

(7) The method for producing bleached pulp of any of above (4) to (6), wherein the peroxomonosulfuric acid treatment is attained according to a combination a treating pH of from 3 to 4, a treating temperature of from 40 to 60° C., and a treating time of from 2 to 5 hours.

(8) The method for producing bleached pulp of above (1) or (4), wherein a chelating agent and/or a polycarboxylic acid is used in the peroxomonosulfuric acid treatment.

(9) The method for producing bleached pulp of above (8), wherein the chelating agent is at least one selected from EDTA, DTPA, NTA, HEDTA, EDTMPA, DTPMPA and NTMPA.

(10) The method for producing bleached pulp of above (8), wherein the chelating agent is added in a range of from 0.02 to 0.3% by mass relative to pulp.

(11) The method for producing bleached pulp of above (8), wherein the polycarboxylic acid is at least one selected from oxalic acid, succinic acid, tartaric acid, maleic acid, fumaric acid, phthalic acid, citric acid, malonic acid, adipic acid and malic acid.

(12) The method for producing bleached pulp of above (8), wherein the polycarboxylic acid is added in a range of from 0.02 to 0.3% by mass relative to pulp.

(13) The method for producing bleached pulp of any of above (1) or (4), wherein the peroxomonosulfuric acid is prepared by mixing sulfuric acid and hydrogen peroxide in a mixing ratio by mol, sulfuric acid/hydrogen peroxide of from 1/1 to 5/1.

(14) The method for producing bleached pulp of above (1) or (4), wherein the alkali-oxygen bleaching is attained in plural reactors.

(15) Paper produced by the use of the bleached pulp produced according to the production method of above (1) or (4), at a papermaking pH of at most 6.

According to the first embodiment of the present invention, a cooked and alkali-oxygen bleached pulp is pre-treated with peroxomonosulfuric acid in multistage chlorine-free bleaching that starts from chlorine dioxide treatment, whereby not only the delignination and HexA removal by peroxomonosulfuric acid can be promoted but also the delignination and HexA removing effect in the chlorine dioxide stage can be promoted, and therefore the amount of the expensive chlorine dioxide to be used in the multistage chlorine-free bleaching step can be thereby reduced. In addition, only extremely slight HexA may remain in the bleached pulp. As a result, the colour reversion resistance of the bleached pulp for acid paper can be enhanced and the bleaching cost can be reduced.

According to the second embodiment of the present invention, peroxomonosulfuric acid treatment of chlorine-free bleached or totally chlorine-free bleached pulp produces bleached pulp by utilizing an already-existing, bleaching pulp stock tower, not requiring the increase in the amount of expensive chlorine dioxide and ozone to be used and not requiring any additional bleaching equipment. As a result, the colour reversion resistance of the bleached pulp for acid paper can be enhanced and the bleaching cost can be reduced.

BEST MODE FOR CARRYING OUT THE INVENTION

Not specifically defined, the lignocellulose substance for use in the present invention includes hardwood, softwood, non-wood such as bamboo and hemp, and their mixtures. Of those, preferred is hardwood from the viewpoint that it contains much glucuronic acid to produce HexA. The cooking method to give pulp for use in the present invention may be any known cooking method of kraft cooking, polysulfide cooking, soda cooking, alkali sulfite cooking or the like. In consideration of the pulp quality, the energy efficiency and the like, preferred is kraft cooking or polysulfide cooking.

For example, in case where lignocellulose of 100% hardwood is kraft-cooked, the sulfidity of the kraft-cooking liquid is generally from 5 to 75%, preferably from 15 to 45%, the effective alkali addition rate is generally from 5 to 30% by mass per absolute dry wood mass, preferably from 10 to 25% by mass, and the cooking temperature is generally from 130 to 170° C., preferably from 140 to 160° C. The cooking method may be either a continuous cooking method or a batchwise cooking method. In case where a continuous cooking digestor is used, employable is a modified cooking method where a cooking liquid is added in plural points, and the cooking method is not specifically defined.

In cooking, a cooking promoter may be added to the cooking liquid used. The promoter may be one or more selected from known cyclic keto compounds, for example, benzoquinone, naphthoquinone, anthraquinone, anthrone, phenanthroquinone, and alkyl or amino-nucleus substituents of those quinone compounds, and hydroquinone compounds that are reduced products of those quinone compounds, such as anthrahydroquinone, and stable compounds obtained as intermediates in anthraquinone production according to a Diels-Alder method, such as 9,10-diketohydroanthracene compounds, etc. Its addition rate may be any known one, for example, in a ratio of from 0.001 to 1.0% by mass per absolute dry mass of wood chips.

In the present invention, the unbleached pulp obtained in a known cooking method is delignated according to a known alkali-oxygen bleaching method, via washing, roughening and cleaning steps. A known middle-consistency method or high-consistency method may be directly applied to the alkali-oxygen bleaching method to be used in the present invention; but preferred is a middle-consistency method where the pulp consistency is from 8 to 15% by mass, which is now generally employed in the art.

In the alkali-oxygen bleaching method according to the above-mentioned middle-consistency method, sodium hydroxide or oxidized kraft white liquor can be used as the alkali, and oxygen from a low-temperature processing method, oxygen from PSA (pressure swing adsorption), oxygen from VSA (vacuum swing adsorption) or the like can be used as the oxygen gas.

The oxygen gas and the alkali are added to a middle-consistency pulp slurry in a middle-consistency mixer, fully mixed therein, and then the pulp, oxygen and alkali mixture is fed under pressure into a reactor tower in which the mixture is kept for a predetermined period of time, and delignated therein. The oxygen gas addition rate is generally from 0.5 to 3% by mass per absolute dry pulp mass, preferably from 1.0 to 2.5% by mass, and the alkali addition rate is generally from 0.5 to 4% by mass, preferably from 1 to 3% by mass. The reaction temperature is generally from 80 to 120° C., preferably from 90 to 110° C., the reaction time is generally from 15 to 100 minutes, preferably from 30 to 100 minutes, and the pulp consistency is generally from 8 to 15% by mass. The other conditions may be known ones.

In the present invention, the above-mentioned alkali-oxygen bleaching is attained continuously plural times in the alkali-oxygen bleaching step, so as to promote the delignination as much as possible and to reduce the heavy metal content, and this is one preferred embodiment.

Preferably, the alkali-oxygen bleached pulp is then processed in a washing step.

The peroxomonosulfuric acid for use in the present invention is not specifically defined in point of its production method. For example, it may be produced by hydrolyzing peroxydisulfuric acid, or may be produced by mixing hydrogen peroxide and sulfuric acid in a desired ratio. Also usable herein is a peroxomonosulfuric acid composite salt ($2KHSO_5.KHSO_4.K_2SO_4$), Oxone. Of those, use of peroxomonosulfuric acid prepared by mixing high-concentration hydrogen peroxide and high-concentration sulfuric acid is preferred in consideration of the economical aspect thereof, and this is a preferred embodiment.

In producing peroxomonosulfuric acid by mixing hydrogen peroxide and sulfuric acid, preferred is a method of dropwise adding concentrated sulfuric acid generally having a concentration of from 80 to 98% by mass, preferably from 93 to 96% by mass, to aqueous hydrogen peroxide generally having a concentration of from 20 to 70% by mass, preferably from 35 to 60% by mass, and mixing them.

The mixing ratio by mol of sulfuric acid to hydrogen peroxide is generally from 1/1 to 5/1, preferably from 2/1 to 4/1. When the concentration of both hydrogen peroxide and sulfuric acid falls within the above range, the production efficiency of peroxomonosulfuric acid can be increased and the risk such as firing can be evaded.

Next described is the first embodiment of the present invention. The first embodiment is a method comprising the above-mentioned alkali-oxygen bleaching followed by peroxomonosulfuric acid treatment and further by multistage chlorine-free bleaching treatment starting from chlorine dioxide treatment.

Regarding the condition of peroxomonosulfuric acid treatment in the first embodiment of the present invention, the addition rate of peroxomonosulfuric acid is generally from 0.01 to 2% by mass per absolute dry pulp mass, preferably from 0.1 to 1% by mass. The treating pH is generally from 1.5 to 6, preferably from 2 to 5. The treating time is generally from 1 minute to 5 hours, preferably from 10 minutes to 200 minutes. The treating temperature is generally from 20° C. to 90° C., preferably from 40° C. to 70° C. The pulp consistency is generally from 5 to 30%, preferably from 8 to 15%.

In the above peroxomonosulfuric acid treatment, the treating pH is especially important. In general, the pH range is from 1.5 to 6, preferably from 2 to 5. When the treating pH range is from 1.5 to 6.0, then the delignination may be attained almost constantly. On the other hand, the HexA decomposition could be the maximum at a pH of around 3; and when the pH oversteps from 3, then the effect may gradually lower. Accordingly, for complete decomposition of HexA, the pH is preferably at most 5. From the viewpoint of preventing the decomposition of cellulose to be caused by the radical formed in reaction of peroxomonosulfuric acid and heavy metal, the pH is preferably at least 2. When the treating pH falls within a range of from 2 to 5, then the viscosity after the peroxomonosulfuric acid treatment may be kept high even though pretreatment for metal ion removal such as chelation treatment is omitted, and after the peroxomonosulfuric acid treatment, chlorine dioxide bleaching can be attained not via alkali extraction.

As a method of controlling the pH in peroxomonosulfuric acid treatment, usable is any known alkali or acid. The addition rate of peroxomonosulfuric acid itself may be changed for pH control in the treatment.

The pulp, after treated with peroxomonosulfuric acid in the above, is preferably washed. Washing prevents the component decomposed and released out in the pulp during the treatment with peroxomonosulfuric acid from being carried over into the multistage chlorine-free bleaching step, and prevents the component from reacting with the bleaching agent such as chlorine dioxide in the bleaching stage to superfluously consume the bleaching agent. In the present invention, the type and the number of the washing machines to be used in the washing stage are not specifically defined. Because of its high washing efficiency, preferably used is a press-type washing machine. After washed, the pulp is fed into the multistage chlorine-free bleaching step.

In the initial stage of the multistage chlorine-free bleaching step, a chlorine dioxide bleaching stage is necessarily inserted. By the peroxomonosulfuric acid treatment and the washing treatment, the amount of HexA in the pulp is reduced; and in addition, since HexA removal is promoted in the chlorine dioxide treatment stage, the amount of HexA in the pulp after the multistage chlorine-free bleaching step may be reduced even though a large amount of chlorine dioxide is not used.

The above-mentioned chlorine dioxide bleaching condition is not specifically defined, and any known condition may be used. For example, the chlorine dioxide addition rate is from 0.1 to 2% by mass per absolute dry pulp mass, preferably from 0.3 to 1.5% by mass; the reaction temperature is generally from 30 to 80° C., preferably from 40 to 70° C.; the reaction time is from 5 to 180 minutes, preferably from 30 to 120 minutes, the reaction pH is from 2.0 to 6.0, preferably from 2.0 to 4.0. Any known alkali and acid may be used for pH control. The pulp consistency is not specifically defined. From the viewpoint of operability, it is preferably from 8 to 15% by mass.

The above-mentioned multistage chlorine-free bleaching step is not specifically defined, except that its initial stage is a chlorine dioxide treatment stage. In a preferred embodiment, the second stage is an alkali extraction stage, and the third stage and after it are a combination of a chlorine dioxide bleaching stage and an alkali-hydrogen peroxide bleaching stage.

Regarding the condition in the alkali extraction stage, the alkali addition rate is generally from 0.5 to 3% by mass per absolute dry pulp mass, preferably from 0.5 to 2.0% by mass, the reaction temperature is generally from 60 to 120° C., preferably from 60 to 80° C., the reaction time is generally from 15 to 120 minutes, the pulp consistency is generally from 8 to 15% by mass. Preferably, oxygen gas is added to the alkali extraction stage. The oxygen gas addition rate is generally from 0.1 to 3% by mass per absolute dry pulp mass, preferably from 0.1 to 1.0% by mass. More preferably, hydrogen peroxide is also added. The hydrogen peroxide addition rate is generally from 0.05 to 2% by mass per absolute dry pulp mass, preferably from 0.1 to 1.0% by mass.

In the alkali-hydrogen peroxide bleaching stage, the hydrogen peroxide addition rate is generally from 0.05 to 2% by mass per absolute dry pulp mass, preferably from 0.1 to 1.0% by mass, the reaction temperature is generally from 60 to 120° C., preferably from 60 to 90° C., the reaction time is generally from 15 to 180 minutes, preferably from 30 to 180 minutes, the pH is generally from 10.5 to 12.0, preferably from 11 to 11.5. Any known alkali and acid may be used for pH control. The pulp consistency is not specifically defined. From the viewpoint of operability, it is preferably from 8 to 15% by mass.

In the chlorine dioxide treatment stage to be inserted except the initial stage, the chlorine dioxide addition rate is generally from 0.1 to 1% by mass per absolute dry pulp mass, preferably from 0.1 to 0.5% by mass, the reaction temperature is generally from 60 to 120° C., preferably from 60 to 80° C., the reaction time is generally from 15 to 300 minutes, preferably from 60 to 180 minutes, the pH is generally from 3.0 to 6.0, preferably from 4 to 5.5. Any known alkali and acid may be used for pH control. The pulp consistency is not specifically defined. From the viewpoint of operability, it is preferably from 8 to 15% by mass.

Next described is the second embodiment of the present invention. The second embodiment is a method comprising the above-mentioned alkali-oxygen bleaching followed by chlorine-free bleaching treatment or totally chlorine-free bleaching treatment and further by peroxomonosulfuric acid treatment. In this, pulp bleached through chlorine-free bleaching or totally chlorine-free bleaching treatment to have a brightness of from 70 to 89% is applied to the peroxomonosulfuric acid treatment.

The chlorine-free bleaching sequence may include a chlorine dioxide-based ECF bleaching sequence of D-Ep-D, D-Eop-D, D-Ep-P-D, D-Eop-P-D, D-Ep-D-D, D-Eop-D-D, D-Ep-D-P or D-Eop-D-P; an ozone-based ECF bleaching sequence of Z-Ep-D, Z-Eop-D, Z-Ep-P-D, Z-Eop-P-D, Z-Ep-D-D, Z-Eop-D-D or Z-Ep-D-P; an ozone/chlorine dioxide-based ECF bleaching sequence of Z/D-Ep-D, Z/D-Eop-D, Z/D-Ep-P-D, Z/D-Eop-P-D, Z/D-Ep-D-D, Z/D-Eop-D-D, Z/D-Ep-D-P or Z/D-Eop-D-P; and a totally chlorine-free bleaching sequence, TCF bleaching sequence of Z-Ep-P, Z-Eop-P, Z-Ep-P-P, Z-Eop-P-P, Z-Ep-Q-P or Z-Eop-Q-P. However, the type of the bleaching sequence does not whatsoever restrict the present invention at all.

The brightness of the pulp bleached in the above-mentioned chlorine-free bleaching sequence of totally chlorine-free bleaching sequence is from 70 to 89% (as measured by JIS P 8148 (2001)) from the viewpoint of the balance between the brightness increase and the bleaching cost, preferably from 80 to 87%. The K value, the HexA amount that is the index of the colour reversion degree of pulp is preferably as low as possible. For this, however, a large amount of a bleaching agent is needed, and this is problematic in point of the pulp viscosity reduction and the cost increase. Accordingly, as the pulp properties suitable to the method of the present invention capable of solving both the problems of pulp colour reversion and bleaching cost increase, the K value is preferably at least 1.5, and the HexA amount is preferably at least 10 μmol/pulp (g).

The pulp bleached in the above-mentioned chlorine-free bleaching sequence or totally chlorine-free bleaching sequence to have desired data of brightness, K value and HexA amount is fed to the peroxomonosulfuric acid treatment step. From the viewpoint of removing the COD (chemical oxidation demand) component from the pulp in the final stage of chlorine-free bleaching treatment or totally chlorine-free bleaching treatment, the pulp is preferably washed prior to the peroxomonosulfuric acid treatment step.

Regarding the condition of peroxomonosulfuric acid treatment in the second embodiment of the present invention, the addition rate of peroxomonosulfuric acid is generally from 0.01 to 2% by mass per absolute dry pulp mass, preferably from 0.1 to 1% by mass. The treating pH is generally from 1.0 to 12.0, preferably from 1.0 to 6.0, more preferably from 2.0 to 4.0. The treating time is generally from 10 minutes to 12 hours, preferably from 30 minutes to 6 hours, more preferably from 2 to 5 hours. The treating temperature is generally from 40° C. to 100° C., preferably from 45° C. to 70° C., more preferably from 40 to 60° C. The pulp consistency is generally from 5 to 30%, but a higher pulp consistency is preferred. Preferably, it is from 10 to 30%.

The viscosity of the pulp treated with peroxomonosulfuric acid in the second embodiment of the present invention may lower but rarely. As a method for preventing the viscosity reduction, the peroxomonosulfuric acid treatment may be attained at a low temperature for a long period of time, or the pH after the peroxomonosulfuric acid treatment may be controlled, whereby the reduction may be evaded. Specifically, when the peroxomonosulfuric acid treating temperature is kept falling from 40 to 60° C. and the treating time is from 2 to 5 hours, then the viscosity reduction may be prevented. When a known alkali or acid is added so as to make the pH after the peroxomonosulfuric acid treatment fall within a range of from 3 to 4, then the viscosity reduction may be prevented. Controlling the three factors of treating temperature, treating time and treating pH to fall within the above range may be more effective for preventing viscosity reduction.

From the viewpoint of preventing the pulp viscosity reduction during the peroxomonosulfuric acid treatment in the first and second embodiments of the present invention, preferably, a chelating agent, a polycarboxylic acid or their mixture is used in the peroxomonosulfuric acid treatment.

The chelating agent includes carboxylic acid-type ones such as ethylenediaminetetraacetic acid (EDTA), diethylenetriamine-pentaacetic acid (DTPA), and nitrilotriacetic acid (NTA); and phosphonic acid-type ones such as 1-hydroxylethylidene-1,1-diphosphonic acid (HEDPA), ethylenediamine-tetra(methylenephosphonic) acid (EDTMPA), diethylenetriamine-penta(methylenephosphonic) acid (DTPMPA), and nitrilotri(methylenephosphonic) acid (NTMPA).

The amount of the chelating agent to be used is generally within a range of from 0.02 to 0.3%, preferably from 0.02 to 0.2% (as % by mass relative to pulp). When the amount of the chelating agent to be used is more than 0.3%, then the HexA removing capability of peroxomonosulfuric acid may lower; and when it is less than 0.02%, then the pulp viscosity reduction could not be prevented.

The polycarboxylic acid includes oxalic acid, succinic acid, tartaric acid, maleic acid, fumaric acid, phthalic acid, citric acid, malonic acid, adipic acid and malic acid.

The amount of the polycarboxylic acid to be used is preferably within a range of from 0.02% to 0.3% (as % by mass relative to pulp). When the amount of the polycarboxylic acid to be used is more than 0.3%, then the HexA removing capability of peroxomonosulfuric acid may lower; and when it is less than 0.02%, then the pulp viscosity reduction could not be prevented.

When a mixture of a chelating agent and a polycarboxylic acid is used, its amount is preferably within a range of from 0.02% to 0.3% (as % by mass relative to pulp). When the amount of the polycarboxylic acid to be used is 0.3% or more, then the HexA removing capability of peroxomonosulfuric acid may lower; and when it is 0.02% or less, then the pulp viscosity reduction could not be prevented.

The bleached pulp produced according to the production method of the present invention may be fed to a papermaking step directly as it is via a storing step, or may be fed to a papermaking step after processed for pH control. The bleached pulp has been processed in the peroxomonosulfuric acid treatment step, and therefore, it is preferably fed to an acid papermaking step. The paper of the present invention is produced generally at a papermaking pH of at most 6 in the acid papermaking step.

The first characteristic of the present invention is as follows: In case where conventional chlorine bleaching is converted into chlorine-free bleaching or totally chlorine-free bleaching, especially in case of hardwood pulp, HexA participating in the colour reversion of paper remains much in the bleached pulp therefore bringing about a problem in that the colour reversion resistance of paper is worsened. For this, a large amount of chlorine dioxide and ozone must be used in the conventional method, therefore bringing about a problem in that the chemical cost increases and the brightness of paper increases too much. According to the production method of the present invention to solve these problems, peroxomonosulfuric acid treatment is carried out in the former stage of chlorine-free bleaching or in the latter stage of chlorine-free bleaching or totally chlorine-free bleaching, not increasing the amount of chlorine dioxide and ozone, whereby the amount of HexA remaining in the bleached pulp can be reduced, and in addition, the peroxomonosulfuric acid treatment can be effectively carried out utilizing the equipment such as stock tower before and after the chlorine-free bleaching step.

The second characteristic is that, in case where the peroxomonosulfuric acid treatment is applied to the former stage of chlorine-free bleaching, the efficiency of the next-stage chlorine dioxide treatment increases and the amount of chlorine dioxide to be used can be thereby reduced.

The third characteristic is that, in case where the peroxomonosulfuric acid treatment is applied to the latter stage of chlorine-free bleaching or totally chlorine-free bleaching, the amount of HexA remaining in the bleached pulp is small and HexA can be removed with reduced chemical costs.

The fourth characteristic is that the additional use of a chelating agent and/or a polycarboxylic acid in the peroxomonosulfuric acid treatment may completely prevent the pulp viscosity reduction by the peroxomonosulfuric acid treatment.

The production method of the present invention is for preventing the degradation of the colour reversion resistance of paper produced from chlorine-free bleached pulp or totally chlorine-free bleached pulp according to an acid papermaking method, in which peroxomonosulfuric acid capable of being produced from inexpensive materials according to an inexpensive method is used, and HexA is economically and efficiently removed, and as a result, the above-mentioned colour reversion resistance can be enhanced.

EXAMPLES

The present invention is described concretely with reference to the following Examples, to which, however, the present invention should not be limited.

Unless otherwise specifically indicated, the kappa value, the potassium permanganate value (K value), the pulp viscosity, the pulp brightness and the HexA content of pulp were measured according to the methods mentioned below, and the colour reversion resistance of pulp was evaluated according to the method mentioned below. "%" indicating the addition rate of chemicals in Examples and Comparative Examples is % by mass per absolute dry pulp mass.

(1) Measurement of Kappa Value of Pulp:

The kappa value is measured according to JIS P 8211.

(2) Measurement of Potassium Permanganate Value (K Value) of Pulp:

The potassium permanganate value is measured according to TAPPI UM 253.

(3) Measurement of Pulp Viscosity:

The pulp viscosity is measured according to J. TAPPI No. 44 method.

(4) Measurement of Pulp Brightness:

Bleached pulp is dispersed in the water, then formed into a sheet having a weight of 60 g/m$^2$ according to JIS P 8209, and the pulp brightness is measured according to JIS P 8148 (2001).

(5) Evaluation of the Colour Reversion Resistance of Pulp (Computation of PC Value):

Sheet production: Bleached pulp is dispersed in the water, then controlled to have a pH of 4.5 with aluminium sulfate added thereto, and then formed into a sheet having a weight of 60 g/m$^2$, which is dried overnight at room temperature with an air drier.

The sheet is seted under a condition of 80° C. and a relative humidity 65% for 24 hours, and from the brightness thereof before and after the colour reversion, the PC value (acid) is computed according to the following formula, thereby evaluating the colour reversion resistance of the pulp. In general, when pulp has a PC value of at most 4.5, the colour reversion resistance of the pulp is evaluated good with no problem.

$$\text{PC value}=[\{(1-\text{brightness after the colour reversion})^2/(2\times\text{brightness after the colour reversion})\}-\{1-\text{brightness before the colour reversion})^2/(2\times\text{brightness before the colour reversion})\}]\times 100.$$

For the PC value (neutral), a sheet is formed in the same manner as above but is controlled to have a pH of 7 without using aluminium sulfate, and the colour reversion resistance of the pulp is evaluated.

(6) Measurement of HexA Content of Pulp:

5 g, as its absolute dry mass, of completely washed pulp is sampled, ultra-pure water is added thereto to make 150 ml as the whole water amount; and then 0.0564 g of formic acid and 0.0208 g of sodium formate are added thereto and well stirred. After the stirring, the whole is transferred into a pressure container, processed at 110° C. for 5 hours for acid hydrolysis of HexA. After the treatment, this is filtered, and the acid hydrolyzates of HexA, 2-furan-carboxylic acid and 5-carboxy-2-furanaldehyde existing in the solution separated through the filtration are quantitatively determined through HPLC. From the total of their molar amounts, the original HexA amount is derived.

First, concretely described is the case of peroxomonosulfuric acid treatment of pulp in the former stage of ECF bleaching.

Production Example 1

Production Example of Peroxomonosulfuric Acid 300.24 g (3 mol) of commercial 96% sulfuric acid was added to 68.02 g (1 mol) of commercial 50 mas. % aqueous hydrogen peroxide to produce peroxomonosulfuric acid. The concentration of the produced peroxomonosulfuric acid was 415 g/liter.

Example 1

900 g, as absolute dry weight, of mixed wood chips of 70% eucalyptus and 30% acacia were collected, and kraft-cooked in a laboratory indirect heating autoclave under the condition of: liquid ratio 4, effective alkali per absolute dry mass of chips 17%, sulfidity of cooking liquid 25%, cooking temperature 160° C. and cooking time 120 minutes. Next, the waste and the pulp were separated, and the pulp was cleaned through a flat screen equipped with a 10-cut screen plate, thereby giving 432 g, as absolute dry weight, of unbleached kraft pulp having a brightness of 38.9%, a kappa value of 18.2 and a pulp viscosity of 43.3 mPa·s.

70.0 g, as absolute dry weight, of the unbleached kraft pulp was collected, 2.0%, per absolute dry pulp mass, of sodium hydroxide was added thereto, then this was diluted with ion-exchanged water to have a pulp consistency of 10%, and put into an indirect heating autoclave. On the assumption of alkali-oxygen bleaching in an up-flow condition in a 50 meters-high reactor tower, commercial 99.9% compressed oxygen gas was injected into it under a gauge pressure of 1 MPa, then the contents were reacted at 95 to 100° C. for 50 minutes with degassing so that the gauge pressure could reduce at a rate of 0.01 MPa/min. After the reaction, this was further degassed to have a gauge pressure of at most 0.05 MPa, and then the pulp was taken out of the autoclave, washed with 7 liters of ion-exchanged water and dewatered. Thus obtained, the pulp had a brightness of 51.3%, a kappa value of 9.4 and a pulp viscosity of 23.3 mPa·s.

60 g, as absolute dry mass, of the alkali-oxygen bleached kraft pulp was collected, put into a plastic bag, and diluted with ion-exchanged water to have a controlled pulp consistency of 10%. Next, the peroxomonosulfuric acid obtained in the above Production Example 1 was added thereto at an addition rate of 0.28% per absolute dry pulp mass, and this was dipped in a thermostat water bath at 60° C. for 60 minutes for peroxomonosulfuric acid treatment. The pH of the pulp slurry in the peroxomonosulfuric acid treatment was 3.0. The obtained pulp was diluted with ion-exchanged water to 3%, dewatered and washed through a Buchner funnel. Thus obtained, the pulp had a brightness of 55.0%, a kappa value of 8.4 and a pulp viscosity of 20.2 mPa·s.

55 g, as absolute dry mass, of the pulp after the peroxomonosulfuric acid treatment was collected, put into a plastic bag, and diluted with ion-exchanged water to have a controlled pulp consistency of 10%. Next, chlorine dioxide was added thereto in an amount of 0.6% per absolute dry pulp mass, and this was dipped in a thermostat water bath at 60° C. for 60 minutes for D1 stage treatment. The pH of the pulp slurry after the treatment was 2.2. The obtained pulp was diluted with ion-exchanged water to 3%, dewatered and washed through a Buchner funnel.

50 g, as absolute dry mass, of the pulp after the D1 stage was collected, put into a plastic bag, and diluted with ion-exchanged water to have a controlled pulp consistency of 10%. Next, 1.0%, per absolute dry pulp mass, of sodium hydroxide and 0.3% of hydrogen peroxide were added thereto, and well mixed, and thereafter this was transferred into a 2-liter stainless, indirect heating autoclave, then compressed with commercial compressed oxygen gas having a purity of 99.9% so as to have a gauge pressure of 0.15 MPa, and reacted at 70° C. for 20 minutes. Next, the pulp slurry was taken out of the autoclave, again transferred into a plastic back, then dipped in a thermostat water bath at 70° C. for 70 minutes for E/OP stage extraction. After the treatment, the pH of the pulp slurry was 11.5. The obtained pulp was diluted with ion-exchanged water to 3%, then dewatered and washed through a Buchner funnel.

45 g, as absolute dry mass, of the pulp after the E/OP stage was put into a plastic bag, diluted with ion-exchanged water to have a controlled pulp consistency of 10%. Next, 0.2%, per absolute dry pulp mass, of chlorine dioxide and 0.05% of sodium hydroxide were added thereto, and dipped in a thermostat water bath at 70° C. for 180 minutes for D2 stage bleaching. The pH of the pulp slurry after the D2 stage was 5.5. The obtained pulp was diluted with ion-exchanged water to 3%, then dewatered and washed through a Buchner funnel.

Thus obtained, the bleached pulp had a brightness of 86.0%, a kappa value of 1.0, an HexA content of 4.9 μmol/pulp(g), a viscosity of 14.1 mPa·s and a PC value of 2.9.

The pH in peroxomonosulfuric acid treatment, the properties (brightness, kappa value, viscosity) of the pulp after the treatment, the sum total of chlorine dioxide addition rate, the K value, the HexA content and the PC value are shown in Table 1.

Example 2

The same operation as in Example 1 was carried out, except that 0.6%, per absolute dry pulp mass, of sulfuric acid was added in peroxomonosulfuric acid treatment to thereby change the pH in peroxomonosulfuric acid treatment to 2.0 and that the chlorine dioxide addition rate in the D1 stage was changed to 0.65%. After the peroxomonosulfuric acid treatment, the pulp had a brightness of 54.8%, a kappa value of 8.5, and a pulp viscosity of 19.7 mPa·s. The bleached pulp had a brightness of 85.9%, a K value of 1.0, an HexA content of 5.0 μmol/pulp (g), a viscosity of 13.8 mPa·s, and a PC value of 2.9.

The pH in peroxomonosulfuric acid treatment, the properties (brightness, kappa value, viscosity) of the pulp after the treatment, the sum total of chlorine dioxide addition rate, the K value, the HexA content and the PC value are shown in Table 1.

Example 3

The same operation as in Example 1 was carried out, except that 2.0%, per absolute dry pulp mass, of sulfuric acid was added in peroxomonosulfuric acid treatment to thereby change the pH in peroxomonosulfuric acid treatment to 1.5 and that the chlorine dioxide addition rate in the D1 stage was changed to 0.7%. After the peroxomonosulfuric acid treatment, the pulp had a brightness of 54.5%, a kappa value of 8.7, and a pulp viscosity of 18.8 mPa·s. The bleached pulp had a brightness of 85.8%, a K value of 1.1, an HexA content of 5.3 μmol/pulp (g), a viscosity of 13.2 mPa·s, and a PC value of 3.0.

The pH in peroxomonosulfuric acid treatment, the properties (brightness, kappa value, viscosity) of the pulp after the treatment, the sum total of chlorine dioxide addition rate, the K value, the HexA content and the PC value are shown in Table 1.

Example 4

The same operation as in Example 1 was carried out, except that 0.4%, per absolute dry pulp mass, of sodium hydroxide was added in peroxomonosulfuric acid treatment to thereby change the pH in peroxomonosulfuric acid treatment to 5.0 and that the chlorine dioxide addition rate in the D1 stage was changed to 0.65%. After the peroxomonosulfuric acid treatment, the pulp had a brightness of 55.3%, a kappa value of 8.4, and a pulp viscosity of 20.9 mPa·s. The bleached pulp had a brightness of 85.8%, a K value of 1.0, an HexA content of 5.1 μmol/pulp(g), a viscosity of 16.2 mPa·s, and a PC value of 2.9.

The pH in peroxomonosulfuric acid treatment, the properties (brightness, kappa value, viscosity) of the pulp after the treatment, the sum total of chlorine dioxide addition rate, the K value, the HexA content and the PC value are shown in Table 1.

Example 5

The same operation as in Example 1 was carried out, except that 0.6%, per absolute dry pulp mass, of sodium hydroxide was added in peroxomonosulfuric acid treatment to thereby change the pH in peroxomonosulfuric acid treatment to 6.0 and that the chlorine dioxide addition rate in the D1 stage was changed to 0.7% After the peroxomonosulfuric acid treatment, the pulp had a brightness of 55.8%, a kappa value of 8.9, and a pulp viscosity of 21.5 mPa·s. The bleached pulp had a brightness of 85.9%, a K value of 1.2, an HexA content of 5.5 μmol/pulp (g), a viscosity of 16.7 mPa·s, and a PC value of 3.1.

The pH in peroxomonosulfuric acid treatment, the properties (brightness, kappa value, viscosity) of the pulp after the treatment, the sum total of chlorine dioxide addition rate, the K value, the HexA content and the PC value are shown in Table 1.

Example 6

The same operation as in Example 1 was carried out, except that the assumption of alkali-oxygen bleaching in an up-flow condition in a 50 meters-high reactor tower was changed to the assumption of two-stage alkali-oxygen bleaching with two, 25 meters-high reactor towers, in which commercial 99.9% compressed oxygen gas was injected thereinto under a gauge pressure of 1 MPa, then the contents were reacted at 95° C. for 25 minutes with degassing so that the gauge pressure could reduce at a rate of 0.01 MPa/min, thereafter commercial 99.9% compressed oxygen gas was injected thereinto under a gauge pressure of 1 MPa, and then the contents were reacted at 95 to 100° C. for 25 minutes with degassing so that the gauge pressure could reduce at a rate of 0.01 MPa/min, and that the chlorine dioxide addition rate in the D1 stage was changed to 0.5%.

After the alkali-oxygen bleaching, the pulp had a brightness of 52.5%, a kappa value of 8.9, and a pulp viscosity of 22.0 mPa·s; and after the peroxomonosulfuric acid treatment, the pulp had a brightness of 56.5%, a kappa value of 7.7, and a pulp viscosity of 19.6 mPa·s. The bleached pulp had a brightness of 86.0%, a K value of 0.9, an HexA content of 4.6 μmol/pulp(g), a viscosity of 16.2 mPa·s, and a PC value of 2.7.

The pH in peroxomonosulfuric acid treatment, the properties (brightness, kappa value, viscosity) of the pulp after the treatment, the sum total of chlorine dioxide addition rate, the K value, the HexA content and the PC value are shown in Table 1.

Example 7

The same operation as in Example 1 was carried out, except that the washing after the peroxomonosulfuric acid treatment was omitted and that the chlorine dioxide addition rate in the D1 stage was 0.65%. After the peroxomonosulfuric acid treatment, the pulp had a brightness of 55.0%, a kappa value of 8.4, and a pulp viscosity of 20.2 mPa·s. The bleached pulp had a brightness of 86.0%, a K value of 1.0, an HexA content of 5.1 μmol/pulp(g), a viscosity of 14.1 mPa·s, and a PC value of 2.9.

The pH in peroxomonosulfuric acid treatment, the properties (brightness, kappa value, viscosity) of the pulp after the treatment, the sum total of chlorine dioxide addition rate, the K value, the HexA content and the PC value are shown in Table 1.

Example 8

The same operation as in Example 1 was carried out, except that the peroxomonosulfuric acid treatment was attained at a temperature of 40° C. and that the chlorine dioxide addition rate in the D1 stage was 0.65%. After the peroxomonosulfuric acid treatment, the pulp had a brightness of 54.8%, a kappa value of 8.6, and a pulp viscosity of 20.8 mPa·s. The bleached pulp had a brightness of 85.9%, a K value of 1.0, an HexA content of 5.0 μmol/pulp(g), a viscosity of 14.5 mPa·s, and a PC value of 2.9.

The pH in peroxomonosulfuric acid treatment, the properties (brightness, kappa value, viscosity) of the pulp after the treatment, the sum total of chlorine dioxide addition rate, the K value, the HexA content and the PC value are shown in Table 1.

Example 9

The same operation as in Example 1 was carried out, except that the peroxomonosulfuric acid treatment was attained at 25° C. and that the chlorine dioxide addition rate in the D1 stage was 0.75%. After the peroxomonosulfuric acid treatment, the pulp had a brightness of 54.1%, a kappa value of 8.9, and a pulp viscosity of 22.1 mPa·s. The bleached pulp had a brightness of 86.1%, a K value of 1.0, an HexA content of 5.0 μmol/pulp(g), a viscosity of 15.3 mPa·s, and a PC value of 2.9.

The pH in peroxomonosulfuric acid treatment, the properties (brightness, kappa value, viscosity) of the pulp after the treatment, the sum total of chlorine dioxide addition rate, the K value, the HexA content and the PC value are shown in Table 1.

Example 10

The same operation as in Example 1 was carried out, except that the peroxomonosulfuric acid treatment was attained at 70° C. and that the chlorine dioxide addition rate in the D1 stage was 0.6%. After the peroxomonosulfuric acid treatment, the pulp had a brightness of 55.2%, a kappa value of 8.4, and a pulp viscosity of 19.6 mPa·s. The bleached pulp had a brightness of 86.2%, a K value of 1.0, an HexA content of 4.8 μmol/pulp(g), a viscosity of 13.9 mPa·s, and a PC value of 2.8.

The pH in peroxomonosulfuric acid treatment, the properties (brightness, kappa value, viscosity) of the pulp after the treatment, the sum total of chlorine dioxide addition rate, the K value, the HexA content and the PC value are shown in Table 1.

Example 11

The same operation as in Example 1 was carried out, except that the peroxomonosulfuric acid treatment was attained at 90° C. and that the chlorine dioxide addition rate in the D1 stage was 0.65%. After the peroxomonosulfuric acid treatment, the pulp had a brightness of 54.3%, a kappa value of 8.8, and a pulp viscosity of 17.9 mPa·s. The bleached pulp had a brightness of 85.8%, a K value of 1.0, an HexA content of 5.2 μmol/pulp(g), a viscosity of 12.8 mPa·s, and a PC value of 2.9.

The pH in peroxomonosulfuric acid treatment, the properties (brightness, kappa value, viscosity) of the pulp after the treatment, the sum total of chlorine dioxide addition rate, the K value, the HexA content and the PC value are shown in Table 1.

Example 12

The same operation as in Example 1 was carried out, except that the peroxomonosulfuric acid treatment was attained for 10 minutes and that the chlorine dioxide addition rate in the D1 stage was 0.65%. After the peroxomonosulfuric acid treatment, the pulp had a brightness of 54.9%, a kappa value of 8.6, and a pulp viscosity of 20.5 mPa·s. The bleached pulp had a brightness of 85.7%, a K value of 1.0, an HexA content of 5.2 μmol/pulp (g), a viscosity of 15.0 mPa·s, and a PC value of 2.9.

The pH in peroxomonosulfuric acid treatment, the properties (brightness, kappa value, viscosity) of the pulp after the treatment, the sum total of chlorine dioxide addition rate, the K value, the HexA content and the PC value are shown in Table 1.

Example 13

The same operation as in Example 1 was carried out, except that the peroxomonosulfuric acid treatment was attained for 5 minutes and that the chlorine dioxide addition rate in the D1 stage was 0.7%. After the peroxomonosulfuric acid treatment, the pulp had a brightness of 54.0%, a kappa value of 8.9, and a pulp viscosity of 21.2 mPa·s. The bleached pulp had a brightness of 86.1%, a K value of 1.0, an HexA content of 5.2 μmol/pulp (g), a viscosity of 15.0 mPa·s, and a PC value of 2.9.

The pH in peroxomonosulfuric acid treatment, the properties (brightness, kappa value, viscosity) of the pulp after the treatment, the sum total of chlorine dioxide addition rate, the K value, the HexA content and the PC value are shown in Table 1.

Example 14

The same operation as in Example 1 was carried out, except that the peroxomonosulfuric acid treatment was attained for 200 minutes and that the chlorine dioxide addition rate in the D1 stage was 0.6%. After the peroxomonosulfuric acid treatment, the pulp had a brightness of 54.7%, a kappa value of 8.3, and a pulp viscosity of 19.4 mPa·s. The bleached pulp had a brightness of 85.8%, a K value of 1.0, an HexA content of 4.8 μmol/pulp (g), a viscosity of 13.7 mPa·s, and a PC value of 2.9.

The pH in peroxomonosulfuric acid treatment, the properties (brightness, kappa value, viscosity) of the pulp after the treatment, the sum total of chlorine dioxide addition rate, the K value, the HexA content and the PC value are shown in Table 1.

Example 15

The same operation as in Example 1 was carried out, except that the peroxomonosulfuric acid treatment was attained for 300 minutes and that the chlorine dioxide addition rate in the D1 stage was 0.6% After the peroxomonosulfuric acid treatment, the pulp had a brightness of 54.2%, a kappa value of 8.2, and a pulp viscosity of 17.1 mPa·s. The bleached pulp had a brightness of 85.5%, a K value of 0.9, an HexA content of 4.7 μmol/pulp (g), a viscosity of 12.6 mPa·s, and a PC value of 2.8.

The pH in peroxomonosulfuric acid treatment, the properties (brightness, kappa value, viscosity) of the pulp after the treatment, the sum total of chlorine dioxide addition rate, the K value, the HexA content and the PC value are shown in Table 1.

Example 16

The same operation as in Example 1 was carried out, except that a chelating agent EDTA was added in an amount of 0.1% relative to pulp, in the peroxomonosulfuric acid treatment. After the peroxomonosulfuric acid treatment, the pulp had a brightness of 54.8%, a kappa value of 8.5, and a pulp viscosity of 20.0 mPa·s. The bleached pulp had a brightness of 85.8%, a K value of 1.2, an HexA content of 5.5 μmol/pulp(g), a viscosity of 14.0 mPa·s, and a PC value of 3.1.

The pH in peroxomonosulfuric acid treatment, the properties (brightness, kappa value, viscosity) of the pulp after the treatment, the sum total of chlorine dioxide addition rate, the K value, the HexA content and the PC value are shown in Table 1.

Example 17

The same operation as in Example 3 was carried out, except that a chelating agent EDTA was added in an amount of 0.1% relative to pulp, in the peroxomonosulfuric acid treatment. After the peroxomonosulfuric acid treatment, the pulp had a brightness of 54.6%, a kappa value of 8.7, and a pulp viscosity of 20.2 mPa·s. The bleached pulp had a brightness of 85.8%, a K value of 1.1, an HexA content of 5.2 μmol/pulp(g), a viscosity of 14.1 mPa·s, and a PC value of 3.1.

The pH in peroxomonosulfuric acid treatment, the properties (brightness, kappa value, viscosity) of the pulp after the treatment, the sum total of chlorine dioxide addition rate, the K value, the HexA content and the PC value are shown in Table 1.

Example 18

The same operation as in Example 3 was carried out, except that a polycarboxylic acid, oxalic acid was added in an amount of 0.1% relative to pulp, in the peroxomonosulfuric acid treatment. After the peroxomonosulfuric acid treatment, the pulp had a brightness of 54.7%, a kappa value of 8.6, and a pulp viscosity of 20.0 mPa·s. The bleached pulp had a brightness of 85.9%, a K value of 1.1, an HexA content of 5.0 μmol/pulp(g), a viscosity of 14.1 mPa·s, and a PC value of 3.0.

The sum total of chlorine dioxide addition rate, the K value, the HexA content and the PC value are shown in Table 1.

Comparative Example 1

The same operation as in Example 1 was carried out, except that the peroxomonosulfuric acid treatment was omitted and that the chlorine dioxide addition rate in the D1 stage was changed to 0.8%. The bleached pulp had a brightness of 85.5%, a K value of 2.2, an HexA content of 10.3 μmol/pulp (g), a viscosity of 16.0 mPa·s, and a PC value of 6.9.

The pH in peroxomonosulfuric acid treatment, the properties (brightness, kappa value, viscosity) of the pulp after the treatment, the sum total of chlorine dioxide addition rate, the K value, the HexA content and the PC value are shown in Table 1.

Comparative Example 2

In Example 1, the alkali-oxygen bleaching time was prolonged to 70 minutes to obtain a pulp having a brightness of 55.1%, a kappa value of 8.4, and a pulp viscosity of 20.6 mPa·s. The pulp was bleached in the same manner as in Example 1, except that the peroxomonosulfuric acid treatment was omitted. The bleached pulp had a brightness of 86.0%, a K value of 1.5, an HexA content of 6.2 μmol/pulp (g), a viscosity of 15.3 mPa·s, and a PC value of 3.4.

The properties (brightness, kappa value, viscosity) of the pulp before the D1 stage bleaching, the sum total of chlorine dioxide addition rate, the K value, the HexA content and the PC value are shown in Table 1.

TABLE 1

| | Peroxomonosulfuric Acid Treatment Condition | | | Properties of Pulp after Peroxomonosulfuric Acid Treatment Condition | | | Total Amount Added of Chlorine | Quality of Bleached Kraft Pulp (BKP) | | | | |
|---|---|---|---|---|---|---|---|---|---|---|---|---|
| | pH | Time (min) | Temperature (° C.) | Brightness (%) | Kappa Value | Viscosity (mPa · s) | Dioxide (mas % relative to pulp) | Brightness (%) | K Value | HexA Content (μmol/pulp(g) | Viscosity (mPa · s) | PC Value |
| Example 1 | 3.0 | 60 | 60 | 55.0 | 8.4 | 20.2 | 0.80 | 86.0 | 1.0 | 4.9 | 14.1 | 2.9 |
| Example 2 | 2.0 | 60 | 60 | 54.8 | 8.5 | 19.7 | 0.85 | 85.9 | 1.0 | 5.0 | 13.8 | 2.9 |
| Example 3 | 1.5 | 60 | 60 | 54.5 | 8.7 | 18.8 | 0.90 | 85.8 | 1.1 | 5.3 | 13.2 | 3.0 |
| Example 4 | 5.0 | 60 | 60 | 55.3 | 8.4 | 20.9 | 0.85 | 85.8 | 1.0 | 5.1 | 16.2 | 2.9 |
| Example 5 | 6.0 | 60 | 60 | 55.8 | 8.9 | 21.5 | 0.90 | 85.9 | 1.2 | 5.5 | 16.7 | 3.1 |
| Example 6 | 3.0 | 60 | 60 | 56.5 | 7.7 | 19.6 | 0.70 | 86.0 | 0.9 | 4.6 | 16.2 | 2.7 |
| Example 7 | 3.0 | 60 | 60 | 55.0 | 8.4 | 20.2 | 0.85 | 86.0 | 1.0 | 5.1 | 14.1 | 2.9 |
| Example 8 | 3.0 | 60 | 40 | 54.8 | 8.6 | 20.8 | 0.85 | 85.9 | 1.0 | 5.0 | 14.5 | 2.9 |
| Example 9 | 3.0 | 60 | 25 | 54.1 | 8.9 | 22.1 | 0.95 | 86.1 | 1.0 | 5.0 | 15.3 | 2.9 |
| Example 10 | 3.0 | 60 | 70 | 55.2 | 8.4 | 19.6 | 0.80 | 86.2 | 1.0 | 4.8 | 13.9 | 2.8 |
| Example 11 | 3.0 | 60 | 90 | 54.3 | 8.8 | 17.9 | 0.85 | 85.8 | 1.0 | 5.2 | 12.8 | 2.9 |
| Example 12 | 3.0 | 10 | 60 | 54.9 | 8.6 | 20.5 | 0.85 | 85.7 | 1.0 | 5.2 | 15.0 | 2.9 |
| Example 13 | 3.0 | 5 | 60 | 54.0 | 8.9 | 21.2 | 0.90 | 86.1 | 1.0 | 5.2 | 15.0 | 2.9 |
| Example 14 | 3.0 | 200 | 60 | 54.7 | 8.3 | 19.4 | 0.80 | 85.8 | 1.0 | 4.8 | 13.7 | 2.9 |
| Example 15 | 3.0 | 300 | 60 | 54.2 | 8.2 | 17.1 | 0.80 | 85.5 | 0.9 | 4.7 | 12.6 | 2.8 |
| Example 16 | 3.0 | 60 | 60 | 54.8 | 8.5 | 20.0 | 0.80 | 85.8 | 1.2 | 5.5 | 14.0 | 3.1 |
| Example 17 | 1.5 | 60 | 60 | 54.6 | 8.7 | 20.2 | 0.90 | 85.8 | 1.1 | 5.2 | 14.1 | 3.1 |
| Example 18 | 1.5 | 60 | 60 | 54.7 | 8.6 | 20.0 | 0.90 | 85.9 | 1.1 | 5.0 | 14.1 | 3.0 |
| Comparative Example 1 | — | — | — | — | — | — | 1.00 | 85.8 | 2.2 | 10.3 | 16.0 | 6.9 |
| Comparative Example 2 | — | — | — | 55.1 | 8.4 | 20.6 | 0.80 | 86.0 | 1.5 | 6.2 | 15.3 | 3.4 |

Examples 1 to 18 are compared with Comparative Example 1. It is known that, in a process where unbleached pulp obtained by cooking a lignocellulose substance is processed for alkali-oxygen bleaching and then processed in an ECF-bleaching step that comprises a chlorine dioxide bleaching stage as the initial stage, when a peroxomonosulfuric acid treatment stage is provided before the ECF-bleaching step, then the amount of chlorine dioxide necessary for producing bleached pulp having a desired brightness can be reduced. Accordingly, as a result, the bleaching cost can be reduced. Further, it is known that, when the peroxomonosulfuric acid treatment stage is provided before the ECF bleaching step, then the HexA content of the pulp having a desired brightness can be greatly reduced. Accordingly, as a result, the PC value can be greatly reduced and the colour reversion resistance of pulp can be enhanced.

Example 1 is compared with Example 7. It is known that, when the peroxomonosulfuric acid treatment stage is followed by washing, then its effect is thereby enhanced.

Examples 1, 2 and 4 are compared with Examples 3 and 5. It is known that, when the peroxomonosulfuric acid treatment stage is controlled to have a pH of from 2 to 5, then its effect is thereby enhanced. Examples 1, 8 and 10 are compared with Examples 9 and 11. It is known that, when the peroxomonosulfuric acid treatment is controlled to have a treating temperature of from 40° C. to 70° C., then its effect is thereby enhanced and, in addition, the treatment can be attained not detracting from the pulp quality.

Examples 1, 12 and 14 are compared with Examples 13 and 15. It is known that, when the peroxomonosulfuric acid treatment is controlled to take a treating time of from 10 to 200 minutes, then its effect is thereby enhanced and, in addition, the treatment can be attained not detracting from the pulp quality.

Specifically, when the combination of the conditions of the peroxomonosulfuric acid treatment stage is such that the pH is from 2 to 5, the treating temperature is from 40 to 70° C. and the treating time is from 10 to 200 minutes, then the treatment can be attained most effectively not detracting from the pulp quality.

Example 3 is compared with Examples 17 and 18. It is known that addition of EDTA or oxalic acid as a viscosity reduction-preventing agent may solve the problem that the pulp viscosity lowers when the pH after the peroxomonosulfuric acid treatment is 1.5, or that is, the addition may prevent the viscosity reduction.

Example 1 is compared with Example 6. It is known that the multistage alkali-oxygen bleaching treatment further enhances its effect.

Example 1 is compared with Comparative Example 2. The additional peroxomonosulfuric acid treatment stage before the multi-stage bleaching step enhances the HexA removal during the multi-stage bleaching treatment.

Example 1 is compared with Examples 2, 3, 4 and 5. When peroxomonosulfuric acid produced by mixing the ingredients in a ratio by mol of sulfuric acid/hydrogen peroxide=3/1 is used, then the system may have a treating pH of 3, at which the HexA removal can be the highest even when any additional pH-controlling agent is not used.

Next concretely described is the case of peroxomonosulfuric acid treatment of pulp after ECF bleaching.

An L-material pulp A that had been processed for oxygen-delignination by kraft cooking/alkali-oxygen bleaching was used. The properties of the pulp A are shown below.

Hunter brightness 48.3%; K value 6.8; viscosity 23.3 mPa·s; HexA content 43.2 μmol/pulp (g).

Production Example 2

Production Example of Peroxomonosulfuric Acid 86.44 g (1.764 mol) of 98 mas. % sulfuric acid was gradually and dropwise added to 50 g (0.882 mol) of 60 mas. % aqueous hydrogen peroxide, taking 45 minutes with keeping the liquid temperature at 60° C. The concentration of the generated peroxomonosulfuric acid was 32.6 mas. %.

Examples 19 to 23

The pulp A that had been processed for alkali-oxygen bleaching after kraft-cooking was bleached according to a D-Eop-D bleaching sequence under the following bleaching condition, and then processed for peroxomonosulfuric acid treatment to give bleached pulp.

Initial Stage D:

Chlorine dioxide was added to the pulp A in an amount of 0.6%, and the pulp was processed under the condition of a pulp consistency of 10% and a temperature of 60° C. for 60 minutes. After the reaction, this was diluted with clean water (filtered tap water) to a pulp consistency of 2.5%, and then dewatered to a pulp consistency of 20% and washed.

Eop:

1.0% sodium hydroxide, 0.15% oxygen and 0.3% hydrogen peroxide were added to the pulp after the above initial stage D, and the pulp was processed under the condition of a pulp consistency of 10% and a temperature of 60° C. for 60 minutes. After the reaction, this was diluted with clean water (filtered tap water) to a pulp consistency of 2.5%, and then dewatered to a pulp consistency of 20% and washed.

Final Stage D:

0.3% chlorine dioxide was added to the pulp after the above Eop stage, and the pulp was processed under the condition of a pulp consistency of 10% and a temperature of 70° C. for 180 minutes. After the reaction, this was diluted with clean water (filtered tap water) to a pulp consistency of 2.5%, and then dewatered to a pulp consistency of 20% and washed.

In the washing step carried out after the bleaching treatment in each stage, the washing degree was 89.6%. The washing degree means how much the liquid in the bleached pulp is exchanged by the washing liquid. For example, when 900 g of a liquid exists in 100 g of bleached pulp, then 3000 g of a washing liquid may be added to the pulp to be a pulp consistency of 2.5%. Further, when the pulp is dewatered to a pulp consistency of 20%, then the amount of the liquid in the pulp is 400 g.

Accordingly, (3900−400)/3900×100=89.6%, and this means that the liquid originally having existed in the pulp was removed to a degree of 89.6% by the washing treatment.

Peroxomonosulfuric Acid Treatment:

The peroxomonosulfuric acid obtained in Production Example 2 was added to the pulp after the final stage D, in the ratio shown in Table 2 (separately 0.3%, 0.6%, 0.9%, 1.2%, 1.5%), and the pulp was processed under the condition of a pulp consistency of 20% and a temperature of 70° C. for 120 minutes to give bleached pulp. The amount of peroxomonosulfuric acid added, the brightness of the bleached pulp, the K value, the HexA content, the viscosity, and the PC value (acid) are shown in Table 2.

Comparative Example 3

The pulp A that had been processed for oxygen bleaching after kraft-cooking was bleached according to a D-Eo-D bleaching sequence under the following bleaching condition, thereby to give bleached pulp.

Initial Stage D:

Chlorine dioxide was added to the pulp A in an amount of 1.1%, and the pulp was processed under the condition of a pulp consistency of 10% and a temperature of 60° C. for 60 minutes. After the reaction, this was diluted with clean water (filtered tap water) to a pulp consistency of 2.5%, and then dewatered to a pulp consistency of 20% and washed.

Eo:

0.8% sodium hydroxide and 0.15% oxygen were added to the pulp after the above initial stage D, and the pulp was processed under the condition of a pulp consistency of 10% and a temperature of 60° C. for 60 minutes. After the reaction, this was diluted with clean water (filtered tap water) to a pulp consistency of 2.5%, and then dewatered to a pulp consistency of 20% and washed.

Final Stage D:

0.3% chlorine dioxide was added to the pulp after the above Eo stage, and the pulp was processed under the condition of a pulp consistency of 10% and a temperature of 70° C. for 180 minutes. The obtained pulp was diluted with clean water (filtered tap water) to a pulp consistency of 2.5%, and then dewatered to a pulp consistency of 20% and washed.

The brightness of the bleached pulp, the K value, the HexA content, the viscosity, and the PC value (acid) are shown in Table 2.

Comparative Example 4

In the same manner as in Comparative Example 3, bleached pulp was obtained according to a D-Eop-D bleaching sequence, for which, however, 0.6% chlorine dioxide was added in the initial stage D, 1.0% sodium hydroxide, 0.15% oxygen and further 0.3% hydrogen peroxide were added in the Eo stage to be an Eop stage, and 0.3% chlorine dioxide was added in the final stage D. The brightness of the bleached pulp, the K value, the HexA content, the viscosity, and the PC value (acid) are shown in Table 2.

TABLE 2

| | Peroxo-monosulfuric Acid Addition Rate (%) | Bright-ness (%) | K Value | HexA Content (μmol/pulp(g)) | Viscosity (mPa · s) | PC Value (acid) |
|---|---|---|---|---|---|---|
| Example 19 | 0.3 | 86.6 | 1.4 | 9.4 | 18.2 | 4.3 |
| Example 20 | 0.6 | 87.2 | 1.2 | 6.3 | 17.4 | 3.7 |
| Example 21 | 0.9 | 87.4 | 0.9 | 3.1 | 16.9 | 2.8 |
| Example 22 | 1.2 | 87.6 | 0.6 | 1.6 | 16.3 | 2.2 |
| Example 23 | 1.5 | 87.6 | 0.4 | 0.8 | 15.9 | 1.8 |
| Comparative Example 3 | no | 88.6 | 1.3 | 7.8 | 18.8 | 3.6 |
| Comparative Example 4 | no | 86.3 | 2.4 | 18.8 | 19.6 | 6.7 |

As in Table 2, the chlorine dioxide-based ECF bleaching not using hydrogen peroxide (Comparative Example 3) requires a large amount of chlorine dioxide to obtain bleached pulp having a K value of at most 1.5 and a PC value of at most 4.5 both on a problemless level in point of the colour reversion resistance thereof. As a result, there occurred problems in that the brightness of the pulp increased too much and the bleaching cost increased. On the other hand, in Comparative Example 4, hydrogen peroxide was used for preventing the bleaching cost from increasing; however in this, the K value was high and the remaining HexA amount was large, and there occurred a problem in that the acid PC value increased. Examples 19 to 23 where peroxomonosulfuric acid was used to solve the above-mentioned problems with the conventional ECF bleaching method; and in these, the K value was reduced and the remaining HexA was efficiently removed, and as a result, the PC value of the pulp for acid papermaking could be reduced to a problemless range.

Comparative Example 5

In the same manner as in Comparative Example 4, bleached pulp was obtained according to a D-Eop-D bleaching sequence, for which, however, 0.70% chlorine dioxide was added in the initial stage D, and 0.25% hydrogen peroxide was added in the Eop stage. The brightness of the bleached pulp, the K value, the HexA content, the viscosity, and the PC value (acid) are shown in Table 3.

Comparative Example 6

In the same manner as in Comparative Example 4, bleached pulp was obtained according to a D-Eop-D bleaching sequence, for which, however, 0.80% chlorine dioxide was added in the initial stage D, and 0.20% hydrogen peroxide was added in the Eop stage. The brightness of the bleached pulp, the K value, the HexA content, the viscosity, and the PC value (acid) are shown in Table 3.

Comparative Example 7

In the same manner as in Comparative Example 4, bleached pulp was obtained according to a D-Eop-D bleaching sequence, for which, however, 0.90% chlorine dioxide was added in the initial stage D, and 0.15% hydrogen peroxide was added in the Eop stage. The brightness of the bleached pulp, the K value, the HexA content, the viscosity, and the PC value (acid) are shown in Table 3.

Example 24

In the same manner as in Comparative Example 5, chlorine-free bleaching was carried out according to a D-Eop-D bleaching sequence. 0.25% peroxomonosulfuric acid was added to the obtained pulp, and the pulp was processed under the condition of a pulp consistency of 20% and a temperature of 70° C. for 120 minutes to give bleached pulp. The brightness of the bleached pulp, the K value, the HexA content, the viscosity, and the PC value (acid) are shown in Table 4.

Example 25

In the same manner as in Comparative Example 6, chlorine-free bleaching was carried out according to a D-Eop-D bleaching sequence. 0.2% peroxomonosulfuric acid was added to the obtained pulp, and the pulp was processed under the condition of a pulp consistency of 20% and a temperature of 70° C. for 120 minutes to give bleached pulp. The brightness of the bleached pulp, the K value, the HexA content, the viscosity, and the PC value (acid) are shown in Table 4.

Example 26

In the same manner as in Comparative Example 7, chlorine-free bleaching was carried out according to a D-Eop-D bleaching sequence. 0.1% peroxomonosulfuric acid was added to the obtained pulp, and the pulp was processed under the condition of a pulp consistency of 20% and a temperature of 70° C. for 120 minutes to give bleached pulp. The brightness of the bleached pulp, the K value, the HexA content, the viscosity, and the PC value (acid) are shown in Table 4.

TABLE 3

| | Brightness (%) | K Value | HexA Content (μmol/pulp(g)) | PC Value (neutral) | PC Value (acid) |
|---|---|---|---|---|---|
| Comparative Example 3 | 88.6 | 1.3 | 7.8 | 2.3 | 3.6 |
| Comparative Example 4 | 86.3 | 2.4 | 18.8 | 4.1 | 6.7 |
| Comparative Example 5 | 86.5 | 2.0 | 16.4 | 3.8 | 6.6 |
| Comparative Example 6 | 86.2 | 1.8 | 13.3 | 3.1 | 6.2 |
| Comparative Example 7 | 86.1 | 1.5 | 10.7 | 2.8 | 4.9 |

TABLE 4

| | Peroxomono-sulfuric Acid Addition Rate (%) | Brightness (%) | K Value | HexA Content (μmol/pulp(g)) | PC Value (acid) |
|---|---|---|---|---|---|
| Example 19 | 0.3 | 86.6 | 1.4 | 9.4 | 4.3 |
| Example 24 | 0.25 | 86.6 | 1.4 | 9.7 | 4.4 |
| Example 25 | 0.2 | 86.6 | 1.2 | 9.3 | 3.8 |
| Example 26 | 0.1 | 87.2 | 1.1 | 8.6 | 3.5 |

As in Table 3, in the neutral papermaking pulp in Comparative Examples 3 to 7 not using peroxomonosulfuric acid, the intended PC value of at most 4.5 could be attained even when the K value was more than 1.5 and the HexA content was more than 10 μmol/pulp (g). On the other hand, the acid papermaking pulp could not have the intended PC value. However, as in Table 4, in Examples 19 and 24 to 26, the acid papermaking pulp could attain the intended PC value by peroxomonosulfuric acid treatment. Accordingly, when the same chlorine-free bleached pulp is formed into paper according to a neutral papermaking method and an acid papermaking method, the acid papermaking pulp may be treated with peroxomonosulfuric acid whereby inexpensive hydrogen peroxide can be used in the chlorine-free bleaching step and, as a result, inexpensive chlorine-free bleached pulp can be produced.

Examples 27 to 31

In the same manner as in Example 20, bleached pulp was produced, for which, however, a chelating agent of DTPA, EDTA, NTA, EDTMPA or DTPMPA was used in an amount of 0.1% in the peroxomonosulfuric acid treatment in Example 20. The brightness of the bleached pulp, the K value, the HexA content and the viscosity are shown in Table 5.

TABLE 5

| | Type of Chelating Agent | Brightness (%) | K Value | HexA Content (μmol/pulp(g)) | Viscosity (mPa · s) |
|---|---|---|---|---|---|
| Example 20 | no | 87.2 | 1.2 | 6.3 | 17.4 |
| Example 27 | DTPA | 87.2 | 1.2 | 6.5 | 19.4 |
| Example 28 | EDTA | 87.4 | 1.2 | 6.4 | 19.6 |
| Example 29 | NTA | 87.6 | 1.2 | 6.6 | 19.3 |
| Example 30 | EDTMPA | 87.5 | 1.2 | 6.8 | 19.6 |
| Example 31 | DTPMPA | 88.4 | 1.2 | 6.3 | 19.6 |

As in Table 5, the chelating agent addition completely solved the problem of some pulp viscosity reduction by peroxomonosulfuric acid treatment.

Examples 32 to 36

In the same manner as in Example 27, bleached pulp was produced, for which, however, DTPA was used in an amount of 0.02%, 0.05%, 0.1%, 0.2%, 0.3% or 0.5%. The brightness of the bleached pulp, the K value, the HexA content and the viscosity are shown in Table 6.

Examples 37 to 41

In the same manner as in Example 28, bleached pulp was produced, for which, however EDTA was used in an amount of 0.02%, 0.05%, 0.1%, 0.2%, 0.3% or 0.5%. The brightness of the bleached pulp, the K value, the HexA content and the viscosity are shown in Table 6.

TABLE 6

| | Chelating Agent | | | | HexA Content | |
|---|---|---|---|---|---|---|
| | Type | Amoun (%) | Brightness (%) | K Value | (μmol/pulp(g)) | Viscosity (mPa · s) |
| Example 20 | no | — | 87.2 | 1.2 | 6.3 | 17.4 |
| Example 32 | DTPA | 0.02 | 87.2 | 1.2 | 6.4 | 18.1 |
| Example 33 | DTPA | 0.05 | 87.2 | 1.2 | 6.5 | 19.2 |
| Example 27 | DTPA | 0.1 | 87.2 | 1.2 | 6.5 | 19.4 |
| Example 34 | DTPA | 0.2 | 87.1 | 1.3 | 6.9 | 18.2 |
| Example 35 | DTPA | 0.3 | 86.9 | 1.4 | 7.5 | 17.8 |
| Example 36 | DTPA | 0.5 | 86.4 | 1.8 | 8.1 | 17.4 |
| Example 37 | EDTA | 0.02 | 87.2 | 1.2 | 6.4 | 18.7 |
| Example 38 | EDTA | 0.05 | 87.2 | 1.2 | 6.5 | 19.4 |
| Example 28 | EDTA | 0.1 | 87.2 | 1.2 | 6.5 | 19.6 |
| Example 39 | EDTA | 0.2 | 87.1 | 1.3 | 6.9 | 18.3 |
| Example 40 | EDTA | 0.3 | 87.0 | 1.4 | 7.5 | 17.8 |
| Example 41 | EDTA | 0.5 | 86.6 | 1.7 | 8.1 | 17.4 |

As in Table 6, the viscosity reduction-preventing agent, DTPA and EDTA is poorly effective when its amount used is too small or is ineffective when its amount used is too large. Accordingly, the amount of the chelating agent to be added is most suitably within a range of from 0.02% to 0.3%.

Examples 42 to 51

In the same manner as in Example 20, bleached pulp was produced, for which, however, oxalic acid, succinic acid, fumaric acid, maleic acid, phthalic acid, tartaric acid, citric acid, malonic acid, adipic acid or malic acid was used in an amount of 0.1% in the peroxomonosulfuric acid treatment in Example 20. The brightness of the bleached pulp, the K value, the HexA content and the viscosity are shown in Table 7.

TABLE 7

| | Poly-carboxylic Acid (%) | Brightness (%) | K Value | HexA Content (μmol/pulp(g)) | Viscosity (mPa · s) |
|---|---|---|---|---|---|
| Example 20 | no | 87.2 | 1.2 | 6.3 | 17.4 |
| Example 42 | oxalic acid | 87.2 | 1.2 | 6.5 | 19.4 |
| Example 43 | succinic acid | 87.1 | 1.2 | 6.3 | 19.6 |
| Example 44 | fumaric acid | 87.3 | 1.2 | 6.7 | 19.3 |
| Example 45 | maleic acid | 87.2 | 1.2 | 6.6 | 19.6 |
| Example 46 | phthalic acid | 87.4 | 1.2 | 6.4 | 19.6 |
| Example 47 | tartaric acid | 87.3 | 1.2 | 6.3 | 19.5 |

TABLE 7-continued

| | Poly-carboxylic Acid (%) | Brightness (%) | K Value | HexA Content (μmol/pulp(g)) | Viscosity (mPa · s) |
|---|---|---|---|---|---|
| Example 48 | citric acid | 87.4 | 1.2 | 6.2 | 19.6 |
| Example 49 | malonic acid | 87.2 | 1.2 | 6.3 | 19.5 |
| Example 50 | adipic acid | 87.1 | 1.2 | 6.5 | 19.4 |
| Example 51 | malic acid | 87.3 | 1.2 | 6.4 | 19.3 |

As in Table 7, the polycarboxylic acid addition completely solved the problem of some pulp viscosity reduction by peroxomonosulfuric acid treatment.

Examples 52 to 56

In the same manner as in Example 42, bleached pulp was produced, for which, however, oxalic acid was used in an amount of 0.02%, 0.05%, 0.2%, 0.3% or 0.5%. The brightness of the bleached pulp, the K value, the HexA content and the viscosity are shown in Table 8.

Examples 57 to 61

In the same manner as in Example 43, bleached pulp was produced, for which, however, succinic acid was used in an amount of 0.02%, 0.05%, 0.2%, 0.3% or 0.5%. The brightness of the bleached pulp, the K value, the HexA content and the viscosity are shown in Table 8.

TABLE 8

| | Polycarboxylic acid | | | | | |
|---|---|---|---|---|---|---|
| | Type | Amount (%) | Brightness (%) | K Value | HexA Content (μmol/pulp(g)) | Viscosity (mPa · s) |
| Example 20 | no | — | 87.2 | 1.2 | 6.3 | 17.4 |
| Example 52 | oxalic acid | 0.02 | 87.2 | 1.2 | 6.3 | 18.1 |
| Example 53 | oxalic acid | 0.05 | 87.2 | 1.2 | 6.4 | 19.3 |
| Example 42 | oxalic acid | 0.1 | 87.2 | 1.2 | 6.5 | 19.4 |
| Example 54 | oxalic acid | 0.2 | 87.1 | 1.2 | 6.6 | 19.1 |
| Example 55 | oxalic acid | 0.3 | 87.0 | 1.3 | 6.6 | 18.8 |
| Example 56 | oxalic acid | 0.5 | 86.9 | 1.5 | 6.9 | 17.4 |
| Example 57 | succinic acid | 0.02 | 87.2 | 1.2 | 6.3 | 18.3 |
| Example 58 | succinic acid | 0.05 | 87.2 | 1.2 | 6.3 | 19.2 |
| Example 43 | succinic acid | 0.1 | 87.1 | 1.2 | 6.3 | 19.6 |
| Example 59 | succinic acid | 0.2 | 87.1 | 1.3 | 6.4 | 19.5 |
| Example 60 | succinic acid | 0.3 | 86.9 | 1.4 | 6.5 | 18.9 |
| Example 61 | succinic acid | 0.5 | 86.2 | 1.6 | 7.0 | 17.4 |

As in Table 8, the viscosity reduction-preventing agent, oxalic acid and succinic acid is poorly effective when its amount used is too small or is ineffective when its amount used is too large. Accordingly, the amount of the polycarboxylic acid to be added is most suitably within a range of from 0.02% to 0.3%.

Examples 62 to 65

In the same manner as in Example 20, bleached pulp was produced, for which, however a mixture of succinic acid and EDTA in the ratio shown in Table 9 below was used in an amount of 0.1% in the peroxomonosulfuric acid treatment in Example 20. The brightness of the bleached pulp, the K value, the HexA content and the viscosity are shown in Table 9.

TABLE 9

| | Blend Ratio of Oxalic Acid/EDTA (by mass) | Brightness (%) | K Value | HexA Content (μmol/pulp(g)) | Viscosity (mPa · s) |
|---|---|---|---|---|---|
| Example 20 | no | 87.2 | 1.2 | 6.3 | 17.4 |
| Example 42 | 100/0 | 87.2 | 1.2 | 6.5 | 19.4 |
| Example 62 | 80/20 | 87.2 | 1.2 | 6.3 | 19.4 |
| Example 63 | 60/40 | 87.5 | 1.2 | 6.3 | 19.6 |
| Example 64 | 40/60 | 87.3 | 1.2 | 6.3 | 19.5 |
| Example 65 | 20/80 | 87.2 | 1.2 | 6.3 | 19.6 |
| Example 28 | 0/100 | 87.4 | 1.2 | 6.4 | 19.6 |

As in Table 9, the combined use of polycarboxylic acid and chelating agent completely solved the problem of viscosity reduction by peroxomonosulfuric acid treatment.

Examples 66 to 68

In the same manner as in Example 20, bleached pulp was produced, for which, however, the treating temperature for the peroxomonosulfuric acid treatment in Example 20 was changed to 40° C., 50° C. or 60° C., and the treating time for it was changed to 5 hours, 4 hours or 2.5 hours. The brightness of the bleached pulp, the K value, the HexA content and the viscosity are shown in Table 10.

TABLE 10

| | Treating Temperature (° C.) | Treating Time (hr) | Brightness (%) | K Value | HexA Content (μmol/pulp(g)) | Viscosity (mPa · s) |
|---|---|---|---|---|---|---|
| Example 20 | 70 | 2.0 | 87.2 | 1.2 | 6.3 | 17.4 |
| Example 66 | 60 | 2.5 | 87.3 | 1.2 | 6.5 | 18.9 |
| Example 67 | 50 | 4.0 | 87.4 | 1.2 | 6.3 | 19.5 |
| Example 68 | 40 | 5.0 | 87.5 | 1.2 | 6.3 | 19.8 |

As in Table 10, for solving the problem of viscosity reduction by peroxomonosulfuric acid treatment, the optimization of the treating temperature and the treating time is effective, whereby the intended K value and the intended HexA content could be attained with keeping the pulp viscosity.

Examples 69 to 77

In the same manner as in Example 20, bleached pulp was produced, for which, however, sodium hydroxide was used in an amount of 1.0%, 1.30%, 1.60%, 1.70%, 1.78%, 1.85%, 1.90%, 2.06% or 2.13%, and the peroxomonosulfuric acid-treating pH was controlled as in Table 11 below. The brightness of the bleached pulp, the K value, the HexA content and the viscosity are shown in Table 11.

TABLE 11

| | Final pH | NaOH (%) | Brightness (%) | K Value | HexA Content (μmol/pulp(g)) | Viscosity (mPa · s) |
|---|---|---|---|---|---|---|
| Example 20 | 1.6 | 0.00 | 87.2 | 1.2 | 6.3 | 17.4 |
| Example 69 | 2.1 | 1.00 | 87.3 | 1.2 | 6.3 | 17.4 |
| Example 70 | 2.5 | 1.30 | 87.5 | 1.2 | 6.3 | 17.9 |
| Example 71 | 2.8 | 1.60 | 87.7 | 1.3 | 6.3 | 18.2 |
| Example 72 | 3.0 | 1.70 | 87.9 | 1.3 | 7.3 | 18.8 |
| Example 73 | 3.3 | 1.78 | 88.1 | 1.3 | 7.3 | 19.1 |
| Example 74 | 3.6 | 1.85 | 88.3 | 1.4 | 8.4 | 19.3 |
| Example 75 | 4.0 | 1.90 | 88.4 | 1.4 | 8.4 | 19.4 |
| Example 76 | 4.5 | 2.06 | 88.4 | 1.7 | 11.1 | 19.7 |
| Example 77 | 5.0 | 2.13 | 88.4 | 1.9 | 18.4 | 20.1 |

As in Table 11, when the peroxomonosulfuric acid-treating pH was less than 3, then the pulp viscosity lowered greatly; and when it was more than 4, the pulp viscosity reduction was small but the HexA removal was poor. Accordingly, the pH range satisfying the two objects of preventing pulp viscosity reduction and increasing HexA removal in peroxomonosulfuric acid treatment falls between 3 and 4.

Examples 78 to 80

In the same manner as in Examples 66 to 68, bleached pulp was produced, for which, however, sodium hydroxide was used in an amount of 1.86%, 1.78% or 1.72%, and the peroxomonosulfuric acid-treating pH was controlled as in Table 12 below. The K value of the bleached pulp, the HexA content and the viscosity are shown in Table 12.

TABLE 12

| | Treating Temperature (° C.) | Final pH | NaOH (%) | K Value | HexA Content (μmol/pulp(g)) | Viscosity (mPa · s) |
|---|---|---|---|---|---|---|
| Example 78 | 60 | 3.7 | 1.86 | 1.4 | 7.9 | 21.6 |
| Example 79 | 50 | 3.3 | 1.78 | 1.3 | 7.6 | 21.5 |
| Example 80 | 40 | 3.1 | 1.72 | 1.3 | 7.3 | 20.8 |

As in Table 12, when the treating temperature was controlled within a range of from 40 to 60° C. and the treating pH was within a range of from 3 to 4, then the pulp viscosity reduction could be more prevented more effectively while keeping the effect of HexA removal.

INDUSTRIAL APPLICABILITY

The method for producing bleaching pulp of the present invention comprises a step of treatment with peroxomonosulfuric acid that can be prepared from an inexpensive material according to an inexpensive process, in the latter stage or former stage of the chorine-free bleaching step or in the latter stage of the totally chlorine-free bleaching step, therefore economically producing bleached pulp from which HexA is removed efficiently. In particular, the bleached pulp is applicable to an acid papermaking process, in which the colour reversion resistance of the bleached pulp of the acid paper produced can be enhanced.

What is claimed is:

1. A method for producing bleached pulp, comprising processing unbleached pulp obtained by cooking a lignocellulose substance, for alkali-oxygen bleaching followed by elemental chlorine-free bleaching treatment to bleach it to a degree of brightness of from 70 to 89% (as measured under JIS P 8148 (2001)), and further followed by treatment with peroxomonosulfuric acid, wherein the peroxomonosulfuric acid treatment is attained according to a combination of an addition rate of the peroxomonosulfuric acid of 0.01 to 2% by mass of actual peroxomonosulfuric acid per absolute dry pulp mass, a treating pH of from 3 to 4, a treating temperature of from 40 to 60° C., and a treating time of from 2 to 5 hours, and wherein the peroxomonosulfuric acid is prepared by mixing sulfuric acid and hydrogen peroxide in a mixing ratio by mol of sulfuric acid to hydrogen peroxide of from 2/1 to 4/1.

2. The method for producing bleached pulp as claimed in claim 1, wherein the K value of the pulp after the elemental chlorine-free bleaching treatment is at least 1.5.

3. The method for producing bleached pulp as claimed in claim 1, wherein the amount of hexeneuronic acid in the pulp after the elemental chlorine-free bleaching treatment is at least 10 μmol/pulp(g).

4. The method for producing bleached pulp as claimed in claim 1, wherein a chelating agent and/or a polycarboxylic acid is used in the peroxomonosulfuric acid treatment.

5. The method for producing bleached pulp as claimed in claim 4, wherein the chelating agent is at least one selected from the group consisting of EDTA, DTPA, NTA, HEDTA, EDTMPA, DTPMPA and NTMPA.

6. The method for producing bleached pulp as claimed in claim 4, wherein the chelating agent is added in a range of from 0.02 to 0.3% by mass relative to pulp.

7. The method for producing bleached pulp as claimed in claim 4, wherein the polycarboxylic acid is at least one selected from the group consisting of oxalic acid, succinic acid, tartaric acid, maleic acid, fumaric acid, phthalic acid, citric acid, malonic acid, adipic acid and malic acid.

8. The method for producing bleached pulp as claimed in claim 4, wherein the polycarboxylic acid is added in a range of from 0.02 to 0.3% by mass relative to pulp.

9. The method for producing bleached pulp as claimed in claim 1, wherein the alkali-oxygen bleaching is attained in plural reactors.

10. The method for producing bleached pulp as claimed in claim 1, wherein said addition rate is 0.1 to 1% by mass of actual peroxomonosulfuric acid per absolute dry pulp mass.

11. The method for producing bleached pulp as claimed in claim 1, wherein consistency of the pulp during the peroxomonosulfuric acid treatment is 5 to 30%.

12. The method for producing bleached pulp as claimed in claim 11, wherein said consistency is 10 to 30%.

13. The method for producing bleached pulp as claimed in claim 4, wherein both said chelating agent and said polycarboxylic acid are used in the peroxomonosulfuric acid treatment.

* * * * *